US010354790B2

(12) United States Patent
Nishimura et al.

(10) Patent No.: US 10,354,790 B2
(45) Date of Patent: Jul. 16, 2019

(54) METHOD FOR MANUFACTURING POWDER MAGNETIC CORE WITH A METALLIC SOFT MAGNETIC MATERIAL POWDER

(71) Applicant: HITACHI METALS, LTD., Tokyo (JP)

(72) Inventors: Kazunori Nishimura, Mishima-gun (JP); Shin Noguchi, Mishima-gun (JP); Toshio Mihara, Mishima-gun (JP)

(73) Assignee: HITACHI METALS, LTD., Tokyo (JP)

( * ) Notice: Subject to any disclaimer, the term of this patent is extended or adjusted under 35 U.S.C. 154(b) by 217 days.

(21) Appl. No.: 15/124,942

(22) PCT Filed: Mar. 12, 2015

(86) PCT No.: PCT/JP2015/057309
§ 371 (c)(1),
(2) Date: Sep. 9, 2016

(87) PCT Pub. No.: WO2015/137452
PCT Pub. Date: Sep. 17, 2015

(65) Prior Publication Data

US 2017/0025215 A1 Jan. 26, 2017

(30) Foreign Application Priority Data

Mar. 13, 2014 (JP) ..... 2014-050032
Jul. 15, 2014 (JP) ..... 2014-144884

(51) Int. Cl.
*H01F 7/06* (2006.01)
*H01F 27/255* (2006.01)
(Continued)

(52) U.S. Cl.
CPC ..... *H01F 27/255* (2013.01); *C22C 38/00* (2013.01); *H01F 1/147* (2013.01); *H01F 1/22* (2013.01);
(Continued)

(58) Field of Classification Search
CPC ... C22C 38/00; H01F 1/22; H01F 1/26; H01F 1/147; H01F 27/255; H01F 41/0246;
(Continued)

(56) References Cited

U.S. PATENT DOCUMENTS 5,242,760 A * 9/1993 Matsuoka ..... H01F 1/15341 336/206
5,575,830 A * 11/1996 Yamashita ..... B22F 9/026 75/348
(Continued)

FOREIGN PATENT DOCUMENTS

CN 102576592 A 7/2012
CN 103229259 A 7/2013
(Continued)

OTHER PUBLICATIONS

International Preliminary on Patentability Report with translation of Written Opinion dated Sep. 22, 2016, issued by the International Searching Authority in application No. PCT/JP2015/057309.
(Continued)

*Primary Examiner* — Paul D Kim
(74) *Attorney, Agent, or Firm* — Sughrue Mion, PLLC

(57) ABSTRACT

An object of the invention is to provide a method that is for manufacturing a powder magnetic core through simple compression molding and capable of manufacturing a complicatedly shaped powder magnetic core with reliable high strength and insulating properties. The invention is directed to a method for manufacturing a powder magnetic core with a metallic soft magnetic material powder, the method includ-
(Continued)

ing: a first step including mixing a soft magnetic material powder and a binder; a second step including compression molding the mixture obtained after the first step; a third step including performing at least one of grinding and cutting on the compact obtained after the second step; and a fourth step including heat-treating the compact after the third step, wherein in the fourth step, the compact is heat-treated so that an oxide layer containing an element constituting the soft magnetic material powder is formed on the surface of the soft magnetic material powder.

8 Claims, 7 Drawing Sheets

(51) Int. Cl.

| | |
|---|---|
| ***C22C 38/00*** | (2006.01) |
| ***H01F 1/26*** | (2006.01) |
| ***H01F 41/02*** | (2006.01) |
| ***H01F 1/147*** | (2006.01) |
| ***H01F 1/22*** | (2006.01) |
| *B22F 1/02* | (2006.01) |

(52) U.S. Cl.
CPC ..... *H01F 1/26* (2013.01); *H01F 41/0246* (2013.01); *B22F 1/02* (2013.01); *B22F 2998/10* (2013.01); *C22C 2202/02* (2013.01)

(58) Field of Classification Search
CPC .. B22F 1/0059; B22F 1/02; B22F 3/02; B22F 3/16; B22F 3/22
See application file for complete search history.

(56) References Cited

U.S. PATENT DOCUMENTS

| | | | | |
|---|---|---|---|---|
| 6,013,225 | A * | 1/2000 | Cadle | B22F 3/16 419/29 |
| 6,646,532 | B2 † | 11/2003 | Fujiwara | |
| 8,123,872 | B2 † | 2/2012 | Hazel | |
| 2011/0267167 | A1 | 11/2011 | Ogawa et al. | |
| 2012/0229244 | A1 | 9/2012 | Ueno et al. | |
| 2013/0200970 | A1 | 8/2013 | Ogawa et al. | |
| 2013/0200972 | A1 | 8/2013 | Wada et al. | |
| 2013/0271256 | A1 | 10/2013 | Ueno et al. | |
| 2014/0154469 | A1 * | 6/2014 | Kagawa | H05K 9/0088 428/155 |
| 2015/0118096 | A1 | 4/2015 | Hasegawa et al. | |

FOREIGN PATENT DOCUMENTS

| | | | | |
|---|---|---|---|---|
| EP | 2 842 665 | A1 | | 3/2015 |
| JP | 08-067941 | A | | 3/1996 |
| JP | 11-204322 | A | | 7/1999 |
| JP | 2005-220438 | A | | 8/2005 |
| JP | 2006-147959 | A | | 6/2006 |
| JP | 2008251735 | A | * | 10/2008 |
| JP | 2011-249836 | A | | 12/2011 |
| JP | 2013-010685 | A | | 1/2013 |
| JP | 2013-084701 | A | | 5/2013 |
| JP | 2013-204121 | A | | 10/2013 |
| WO | 2013/161744 | A1 | | 10/2013 |

OTHER PUBLICATIONS

Japanese Office Action issued in the corresponding JP Patent Application No. 2015-539994 dated Nov. 12, 2015.
International Search Report of PCT/JP2015/057309 dated May 19, 2015 [PCT/ISA/210].
Communication dated Oct. 27, 2017 from the European Patent Office in counterpart application No. 15760682.3.
Communication dated Sep. 30, 2017, from State Intellectual Property Office of the P.R.C. in counterpart application No. 201580013307.8.
Communication dated Apr. 11, 2019 from the European Patent Office in counterpart application No. 15760682.3.

* cited by examiner
† cited by third party

METHOD FOR MANUFACTURING POWDER MAGNETIC CORE WITH A METALLIC SOFT MAGNETIC MATERIAL POWDER

CROSS REFERENCE TO RELATED APPLICATIONS

This application is a National Stage of International Application No. PCT/JP2015/057309, filed Mar. 12, 2015 (claiming priority based on Japanese Patent Application Nos. 2015-050032, filed Mar. 13, 2014, and 2014-144884, filed Jul. 15, 2014), the contents of which are incorporated herein by reference in their entirety.

TECHNICAL FIELD

The invention relate to a powder magnetic core produced with a soft magnetic material powder and to a method for manufacturing a powder magnetic core.

BACKGROUND ART

Traditionally, coil components such as inductors, transformers, and chokes are used in a wide variety of applications such as home electric appliances, industrial apparatuses, and vehicles. A coil component is composed of a magnetic core and a coil wound around the magnetic core. Such a magnetic core often includes ferrite, which is superior in magnetic properties, freedom of shape, and cost.

In recent years, as a result of downsizing of power supplies for electronic devices, there has been a strong demand for compact low-profile coil components operable even with a large current. Powder magnetic cores produced with a metallic magnetic powder, which has a saturation magnetic flux density higher than that of ferrite, are increasingly used for magnetic cores for such coil components. Such a metallic magnetic powder includes, for example, an Fe—Si alloy, an Fe—Ni alloy, or an Fe—Si—Al alloy.

Powder magnetic cores obtained through compaction of a metallic magnetic powder such as an Fe—Si alloy powder have high saturation magnetic flux density, but have low electrical resistivity because they are produced with a metallic magnetic powder. Therefore, methods for improving insulation between magnetic particles are used, such as forming an insulating coating on the surface of a magnetic powder and then molding the magnetic powder. Patent Document 1 discloses an example of the use of an Fe—Cr—Al magnetic powder that can produce, by itself, a high-electric-resistance material capable of acting as an insulating coating. Patent Document 1 discloses a process that includes subjecting a magnetic powder to oxidation so that an oxide coating with high electric resistance is formed on the surface of the magnetic powder and then solidifying and molding the magnetic powder by discharge plasma sintering to form a powder magnetic core.

Patent Document 2 discloses that soft magnetic alloy particles including iron, chromium, and silicon are oxidized to form an oxide layer on the surface of the particles, the content of chromium in the oxide layer is higher than that in the alloy particles, and the particles are bonded together with the oxide layer interposed therebetween.

PRIOR ART DOCUMENTS

Patent Documents

Patent Document 1: JP-A-2005-220438
Patent Document 2: JP-A-2011-249836

SUMMARY OF THE INVENTION

Problems to be Solved by the Invention

When a coil component is formed to have a structure in which a coil is wound around a small powder magnetic core obtained by compression molding, the strength of the powder magnetic core can be insufficient so that the powder magnetic core can be easily broken when the wire is wound around the core. Since a high molding pressure is necessary for an increase in the strength of the powder magnetic core, there are also problems with manufacturing facility, such as an increase in the size of the system for producing high pressure and vulnerability of the molding die to breakage under high pressure. Therefore, powder magnetic cores available for practical use have a limited strength. As mentioned above, an alloy powder may be subjected to molding after an insulating coating is formed on the surface of the powder. In this case, there is also a problem in that when the molding pressure is increased in order to increase the compact strength, the insulating coating between the magnetic particles can be damaged so that the insulating properties can be degraded, although the compact can be obtained with a relatively high degree of shape freedom.

The process described in Patent Document 1 does not need high pressure in contrast to the above but requires complicated facilities and a long time. In addition, the process is also complicated because a step for grinding an aggregated powder is necessary after the oxidation of the magnetic powder. In addition, the method shown in Patent Document 1 has difficulty in forming a magnetic core with a complicated shape such as a drum shape although it is advantageous for increasing insulating properties and strength.

The features disclosed in Patent Document 2 do not provide any method suitable for the production of a complicatedly shaped magnetic core although according to them, an insulating layer can be easily formed by a heat treatment in an oxidizing atmosphere.

In view of the above problems, an object of the invention is to provide a method that is for manufacturing a powder magnetic core through simple compression molding and capable of manufacturing a complicatedly shaped powder magnetic core with reliable high strength and insulating properties. Another object of the invention is to provide a powder magnetic core having a drum shape as a typical complicated shape and having high strength and insulating properties.

Means for Solving the Problems

The invention is directed to a method for manufacturing a powder magnetic core with a metallic soft magnetic material powder, the method including: a first step including mixing a soft magnetic material powder and a binder; a second step including compression molding the mixture obtained after the first step; a third step including performing at least one of grinding and cutting on the compact obtained after the second step; and a fourth step including heat-treating the compact after the third step, wherein in the fourth step, the compact is heat-treated so that an oxide layer containing an element constituting the soft magnetic material powder is formed on the surface of the soft magnetic material powder.

In the method for manufacturing a powder magnetic core, the first step preferably includes spray drying a slurry containing the soft magnetic material powder and the binder.

The soft magnetic material powder is preferably an Fe—Cr—Al soft magnetic material powder.

The method for manufacturing a powder magnetic core preferably further includes a preheating step between the second step and the third step, wherein the preheating step includes heating the compact at a temperature lower than the heat treatment temperature in the fourth step.

In the method for manufacturing a powder magnetic core, the compact subjected to the third step preferably has a space factor of 78 to 90%. In the third step, the compact obtained after the second step is preferably subjected to cutting.

In the method for manufacturing a powder magnetic core, at least one of the grinding and the cutting is preferably performed on at least a coil holding part of the powder magnetic core. In the method for manufacturing a powder magnetic core, the powder magnetic core preferably has a drum shape including the coil holding part and flanges at both ends of the coil holding part.

The invention is directed to a powder magnetic core including metallic soft magnetic material particles and having a drum shape including a coil holding part and flanges at both ends of the coil holding part, wherein the surface of the coil holding part has an arithmetic average roughness larger than the arithmetic average surface roughness of the outer surface of the flange, the metallic soft magnetic material particles are bonded together with an oxide layer that is interposed therebetween and contains an element constituting the metallic soft magnetic material particles, and the surface of the coil holding part is a worked surface and has the oxide layer containing an element constituting the soft magnetic material particles.

In the powder magnetic core, at least one of the flanges at both ends preferably has a maximum dimension larger than the axial dimension in the drum shape.

In the powder magnetic core, the soft magnetic material particles are preferably Fe—Cr—Al soft magnetic material particles.

Effect of the Invention

The invention makes it possible to provide a method that is for manufacturing a powder magnetic core through simple compression molding and capable of forming a complicated shape with reliable high strength and insulating properties.

The invention also makes it possible to provide a powder magnetic core having a drum shape as a typical complicated shape and having high strength and insulating properties.

MODE FOR CARRYING OUT THE INVENTION

Hereinafter, embodiments of the powder magnetic core and the powder magnetic core manufacturing method according to the invention will be specifically described, which, however, are not intended to limit the invention.

Figure 1:
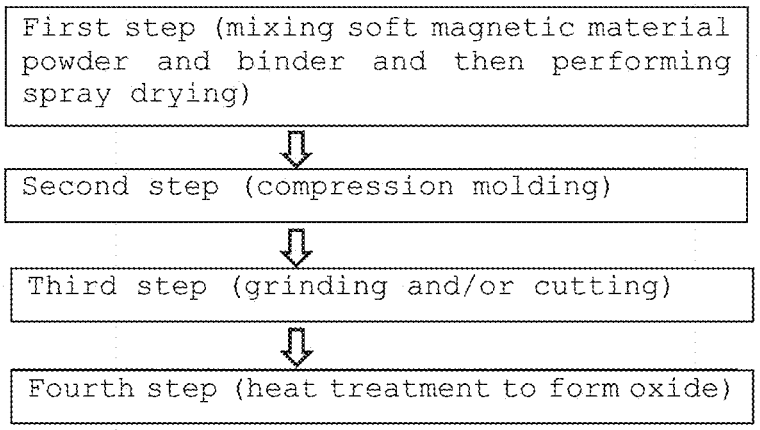
FIG. 1 is a process flow chart for illustrating an embodiment of the method according to the invention for manufacturing a powder magnetic core.

FIG. 1 is a process flow chart for illustrating an embodiment of the method according to the invention for manufacturing a powder magnetic core. The manufacturing method shown in FIG. 1 is a method for manufacturing a powder magnetic core with a metallic soft magnetic material powder, the method including: a first step including mixing a soft magnetic material powder and a binder and then subjecting the mixture to spray drying; a second step including compression molding the mixture obtained after the first step; a third step including performing at least one of grinding and cutting (hereinafter also referred to as "grinding or the like") on the compact obtained after the second step; and a fourth step including heat-treating the compact after the third step. In the fourth step, the compact is heat-treated so that an oxide layer containing an element constituting the soft magnetic material powder is formed on the surface of the soft magnetic material powder.

In the fourth step, the heat treatment forms the oxide layer, with which the soft magnetic material particles are bonded together and insulated from each other. The insulating oxide layer can be formed on the surface of the soft magnetic material powder only by performing the heat treatment on the compact, which makes the insulating coating-forming step simple. In addition, one of the features of the invention is the third step including performing grinding or the like to obtain a predetermined shape, size, or geometry before the fourth step for imparting high strength to the powder magnetic core.

The oxide layer formed by the heat treatment in the fourth step can form a high-strength powder magnetic core. However, because of the high strength, the powder magnetic core is difficult to work after the heat treatment. In addition, if working is performed after the heat treatment, the metal part of the soft magnetic material powder would be exposed in the worked area, so that reliable insulating properties cannot be maintained without any modification. Therefore, the process flow used includes finishing grinding or the like to obtain a predetermined shape before the fourth step and then performing the heat treatment to form the oxide layer. Immediately after the second step, the compact has a radial crushing strength of, for example, about 5 to about 15 MPa, which is about 1/10 or less of that of the magnetic core after the heat treatment of the fourth step. Therefore, the compact obtained immediately after the second step can be easily subjected to grinding or the like. In addition, if the metal part is exposed by grinding or the like, the part will be covered with the oxide layer through the heat treatment of the fourth step. Therefore, using the process flow, the issues concerning working and insulating properties can be resolved at the same time.

First, the soft magnetic material powder to be supplied to the first step will be described. The metallic soft magnetic material powder may be of any type having magnetic properties enough to form a powder magnetic core and being capable of forming, on its surface, an oxide layer containing an element constituting it. The metallic soft magnetic material powder may include any of various ferromagnetic elemental metals or ferromagnetic alloys. A preferred form of the metallic soft magnetic material powder is, for example, an Fe—Cr—M alloy powder, wherein M is at least one of Al and Si. The Fe—Cr—M alloy powder, which contains Cr in addition to the base element Fe, possesses corrosion resistance superior to, for example, an Fe—Si alloy powder. Since Al and Si are elements capable of improving the magnetic properties such as magnetic permeability, the Fe—Cr—M alloy powder (M is at least one of Al and Si) containing at least one of Al or Si in addition to Cr is more preferred as the soft magnetic material powder. In particular, an Fe—Cr—Al or Fe—Cr—Al—Si alloy powder, which contains Al as the M element, has a higher level of corrosion resistance and plastic deformability than an Fe—Si or Fe—Si—Cr alloy powder. Specifically, when an Fe—Cr—Al or Fe—Cr—Al—Si alloy powder is used, a powder magnetic core with a high level of space factor and strength can be obtained even under a low molding pressure. This makes it possible to avoid the use of a large and/or complicated molding machine. In addition, the ability to mold at low pressure suppresses mold breakage and improves productivity.

In addition, when a metallic soft magnetic material powder such as the Fe—Cr—M alloy powder is used, an insulating oxide can be formed on the surface of the soft magnetic material powder by a heat treatment after the molding as described below. Therefore, the step of forming an insulating oxide before molding can be omitted, and the method of forming an insulting coating can also be simplified. These features also make it possible to improve productivity.

Hereinafter, the case where the Fe—Cr—M alloy powder is used as an example of the soft magnetic material powder will be described.

The Fe—Cr—M alloy powder (M is at least one of Al and Si) is an Fe-based soft magnetic material powder in which Fe is a base element at the highest content and Cr and M have the next highest contents (the contents of Cr and M may be in any order). The Fe—Cr—M soft magnetic material powder may have any specific composition as long as it can form a powder magnetic core. Cr is an element capable of improving corrosion resistance and other properties. From this point of view, the Cr content is preferably, for example, 1.0% by weight or more. The Cr content is more preferably 2.5% by weight or more. On the other hand, too high a Cr content can reduce the saturation magnetic flux density. Therefore, the Cr content is preferably 9.0% by weight or less, more preferably 7.0% by weight or less, even more preferably 4.5% by weight or less.

Like Cr, Al is an element capable of improving corrosion resistance and other properties. Al can also contribute to the formation of a surface oxide. In addition, as mentioned above, the addition of Al can significantly improve the strength of the powder magnetic core. From these points of view, the Al content is preferably, for example, 2.0% by weight or more, more preferably 5.0% by weight or more. On the other hand, too high an Al content can also reduce the saturation magnetic flux density. Therefore, the Al content is preferably 10.0% by weight or less, more preferably 8.0% by weight or less, even more preferably 6.0% by weight or less. In view of the corrosion resistance and other properties, the total content of Cr and Al is preferably 6.0% by weight or more, more preferably 9.0% by weight or more.

Si is effective in improving the magnetic properties. Si may be added instead of or together with Al. When Si is added to improve the magnetic properties, the Si content is preferably 1.0% by weight or more. On the other hand, too high a Si content can reduce the strength of the powder magnetic core, and therefore, the Si content is preferably 3.0% by weight or less. When the strength needs to have a higher priority than other properties, the Si content is preferably as low as the content of inevitable impurities. In this case, for example, the Si content is preferably controlled to less than 0.5% by weight.

The remainder other than Cr and M is composed mainly of Fe. The remainder may also contain any other elements as long as the good formability and other advantages of the Fe—Cr-M soft magnetic material powder can be obtained. It should be noted that the content of non-magnetic elements other than inevitable impurities is preferably 1.0% by weight or less because of their ability to reduce the saturation magnetic flux density and other values. The Fe—Cr—M soft magnetic material powder is more preferably composed of Fe, Cr, and M except for inevitable impurities.

The average particle size of the soft magnetic material powder (in this case, the median diameter d50 in the cumulative particle size distribution) may be, for example, but not limited to, 1 μm to 100 μm. The strength, core loss, and high-frequency properties of the powder magnetic core can be improved by reducing the average particle size. Therefore, the median diameter d50 is more preferably 30 μm or less, even more preferably 15 μm or less. On the other hand, the magnetic permeability can decrease with decreasing average particle size. Therefore, the median diameter d50 is more preferably 5 μm or more.

The soft magnetic material powder may be in any form. In view of fluidity and other properties, for example, a granular powder such as an atomized powder is preferably used. An atomization method such as gas atomization or water atomization is suitable for the production of a powder of an alloy that has high malleability or ductility and is hard to grind. An atomization method is also advantageous for obtaining substantially spherical particles of the soft magnetic material.

Next, the binder used in the first step will be described. During the compression molding, the binder binds the particles to impart, to the compact, a strength enough to withstand grinding or the like or handling after the molding. The binder may be of any type. For example, any of various thermoplastic organic binders may be used, such as polyethylene, polyvinyl alcohol (PVA), and acrylic resins. Organic binders are thermally decomposed by the heat treatment after the molding. Therefore, an inorganic binder, such as a silicone resin, capable of remaining as a solid and binding the particles even after the heat treatment, may be used in combination with an organic binder. In the powder magnetic core manufacturing method according to the invention, however, the oxide layer formed in the fourth step can function to bind the soft magnetic material particles. Therefore, the process should preferably be simplified by omitting the use of the inorganic binder.

The content of the binder is preferably such that the binder can be sufficiently spread between the soft magnetic material particles to ensure a sufficient compact strength. However, too high a binder content can reduce the density or strength. For example, the binder content is preferably from 0.25 to 3.0 parts by weight based on 100 parts by weight of the soft magnetic material powder. The binder content is more preferably from 0.5 to 1.5 parts by weight in order to withstand grinding or the like in the third step.

In the first step, the soft magnetic material powder and the binder may be mixed by any method. The mixture obtained by the mixing is preferably subjected to a granulation process in view of formability and other properties. Various methods may be used for such a granulation process. In particular, the first step preferably includes a spray drying step as a granulation process after the mixing of the soft magnetic material powder and the binder. In such a spray drying step, a mixture slurry including the soft magnetic material powder, the binder, and a solvent such as water may be spray-dried using a spray dryer. The spray drying can produce a granulated powder with a sharp particle size distribution and a small average particle size. The use of such a granulated powder can improve the workability after the molding described below. When the granulated powder used has similar small particle sizes, the irregularities of the worked surface can be kept small and chipping and other defects can be suppressed, even if the granular particles are cut at grain boundaries during grinding or the like. When the granulation is performed by spray drying, the ratio of $R_{MD}$ to $R_{AS}$ ($R_{MD}/R_{AS}$) can be 5 or less, wherein $R_{MD}$ is the average of arithmetic average roughness Ra values of the worked surface (e.g., the surface of the coil holding part (the surface of the part on which a conducting wire is to be wound)), and $R_{AS}$ is the average of arithmetic average roughness Ra values of the unworked surface (e.g., the outer surface of the flange, which is the axial end surface). The ratio $R_{MD}/R_{AS}$ is more preferably 3 or less. When the irregularities of the worked surface are kept small, it can be expected to reduce the risk of breakage starting from the irregularities. The arithmetic average roughness to be used can be obtained by evaluating the surface roughness values of a plurality of sites each with an area of at least 0.3 $mm^2$ using an ultra-deep shape measuring microscope and averaging the values. Using spray drying, substantially spherical granular particles can be obtained, so that high powder-feeding ability (high powder fluidity) can be achieved for the molding. The granulated powder preferably has an average particle size (median diameter d50) of 40 to 150 μm, more preferably 60 to 100 μm.

Figure 2:
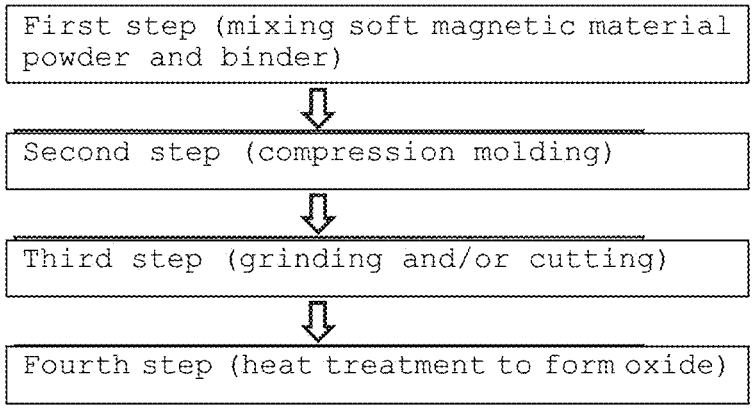
FIG. 2 is a process flow chart for illustrating another embodiment of the method according to the invention for manufacturing a powder magnetic core.

On the other hand, spray drying granulation is not essential (FIG. 2). For example, the Fe—Cr—Al soft magnetic material powder, in which Al is the element M, has particularly good formability, and thus the use of the Fe—Cr—Al soft magnetic material powder makes it possible to subject a high-strength compact to grinding or the like. This can suppress chipping and other defects during grinding or the like.

A granulation method other than spray drying may be used, such as rolling granulation. In this case, for example, the mixed powder forms an aggregated powder with a wide particle size distribution due to the binding action of the binder being mixed. Therefore, the mixed powder may be allowed to pass through a sieve, for example, using a vibrating sieve, so that a granulated powder with a desired secondary particle size suitable for molding can be obtained.

A lubricant such as stearic acid or a stearic acid salt is preferably added to the granulated powder in order to reduce the friction between the powder and the die during the compression molding. The content of the lubricant is preferably from 0.1 to 2.0 parts by weight based on 100 parts by weight of the soft magnetic material powder. Alternatively, the lubricant may be applied or sprayed onto the die.

Next, the second step including compression molding the mixture obtained after the first step will be described. The mixture obtained in the first step is preferably granulated as described above and then subjected to the second step. Using a molding die, the granulated mixture is compression-molded into a predetermined shape such as a cylindrical shape, a rectangular solid shape, or a toroidal shape. In the second step, the molding may be room temperature molding or warm molding in which heating is performed to such an extent as not to eliminate the organic binder.

In the second step, it is not always necessary to obtain a near-net-shape compact. This is because grinding or the like is performed in the third step described below.

Next, the third step including performing at least one of grinding and cutting on the compact obtained after the second step will be described. The mechanical working such as grinding or the like is performed to form the compact into a predetermined shape or size. The grinding can be performed using a rotary grindstone or other tools, and the cutting can be performed using a cutting tool. Grinding or the like, which may include deburring with an abrasive-carrying brush or working for other purposes, is preferably performed on at least the coil holding part of the powder magnetic core. This is because if working to form a predetermined shape, such as working to form the coil holding part, is performed after the heat treatment described below, the working process would be complicated. The use of the third step is more preferred when the powder magnetic core should be shaped to have a concave shape, such as a drum shape including a coil holding part and flanges at both ends thereof, which is difficult to work after the heat treatment.

In order to prevent chipping and other defects during the working in the third step and to increase machining accuracy, it is effective to increase the space factor of the compact to be subjected to the third step. On the other hand, an excessive increase in the space factor of the compact may result in poor mass-productivity. The space factor of the compact to be subjected to the third step is preferably from 78 to 90%, more preferably from 79 to 88%, even more preferably from 81 to 86%. Also when the Fe—Cr—Al soft magnetic material powder with high formability is used, the space factor of the compact to be subjected to the third step can be increased to 82% or more even at a low molding pressure. In the second step, the space factor of the compact can be controlled to fall within such a range by controlling the molding pressure or other conditions. In this regard, the space factor (relative density) of the compact to be subjected to the third step is calculated by dividing the density of the compact by the true density of the soft magnetic material powder. In this case, the weight of the binder and the lubricant in the compact, which is based on the added amount, is subtracted from the weight of the compact. The true density of the soft magnetic material powder may be the density of an ingot prepared by melting a material with the same composition.

The drum shape includes a columnar coil holding part and protruding flanges at both ends of the coil holding part. Examples of the drum shape include, but are not limited to, a shape including a cylindrical coil holding part and disk-shaped flanges at both ends thereof, a shape including a cylindrical coil holding part, a disk-shaped flange at one end thereof, and a square plate-shaped flange at the other end thereof, a shape including a cylindrical coil holding part and square plate-shaped flanges at both ends thereof, and a shape including a square pole-shaped coil holding part and square plate-shaped flanges at both ends thereof. According to the features of the invention, a flat drum-shaped powder magnetic core may be produced, in which at least one of the flanges at both ends has a maximum dimension larger than the height of the drum shape, in other words, the axial dimension. In this case, the effect of the invention is remarkable. The invention is more effective for the production of a deep drum-shaped powder magnetic core with a narrow concave part, such as a shape in which the maximum flange dimension is at least twice the core diameter (the diameter of the coil holding part). It is because these shapes are difficult to form in both when integral molding is used and when working such as grinding is used. The term "maximum dimension" means, for example, the diameter of a disk-shaped flange, the major axis of an oval plate-shaped flange, or the diagonal dimension of a square plate-shaped flange. This also applies to shapes having a flange at only one end of the coil holding part.

A method of forming the drum shape includes, for example, forming a cylindrical or prismatic compact in the second step and then forming a concave part by the grinding or the like of the cylindrical or prismatic compact in the direction from the side to the central axis. At the stage immediately after the second step, it is easy to perform grinding or the like on the compact, so that the working step can be significantly simplified, because the oxide layer described below for imparting a high strength to the powder magnetic core is still not formed at the stage.

Next, the fourth step including heat-treating the compact after the third step will be described. The compact after the third step is heat-treated in order to form an oxide layer, which contains an element constituting the soft magnetic material powder, on the surface of the metallic soft magnetic material particles constituting the compact. For example, when the metallic soft magnetic material used is the Fe—Cr—M powder (M is at least one of Al and Si), the following features can be obtained. When M is Si, in other words, when Al is not intentionally added, the oxide layer particularly becomes Cr-rich, so that the oxide layer formed on the surface of the soft magnetic material particles has a higher ratio of the Cr content to the total content of Fe, Cr, and M (Si) than that of the inner alloy phase. On the other hand, when Al is added as M, the oxide layer particularly becomes Al-rich, so that the oxide layer formed on the surface of the soft magnetic material particles has a higher ratio of the Al content to the total content of Fe, Cr, and M than that of the inner alloy phase. It is also expected that the heat treatment can be effective in relaxing the stress/strain introduced by the molding or the like and thus producing good magnetic properties.

The heat treatment may be performed in an oxygen-containing atmosphere such as the air or a mixed gas of oxygen and inert gas. The heat treatment may also be performed in a water vapor-containing atmosphere such as a mixed gas of water vapor and inert gas. Among them, the heat treatment in the air is simple and preferred. The pressure of the heat treatment atmosphere is preferably, but not limited to, the air pressure, at which no pressure control is necessary.

The heat treatment oxidizes the soft magnetic material particles to form an oxide layer on their surface as described above. The oxide layer forms a grain boundary phase between the soft magnetic material particles to improve the insulating properties and corrosion resistance of the soft magnetic material particles. In addition, the oxide layer, which is formed after the formation of the compact, also contributes to the bonding of the soft magnetic material particles, which are bonded with the oxide layer interposed therebetween.

In the third step, where grinding or cutting is performed as mentioned above, the inner alloy phase is exposed at the worked surface of the soft magnetic material particles. However, the exposed alloy-phase part is covered with the oxide layer formed by the heat treatment in the fourth step, so that the insulation of the worked surface is ensured. The heat treatment in the fourth step can serve simultaneously to remove the strain introduced during the molding, to bond the soft magnetic material particles, and to form a worked surface-insulating layer. Therefore, the heat treatment enables efficient production of a powder magnetic core with high strength and high insulating properties.

In the fourth step, the heat treatment may be performed at a temperature that allows the oxide layer to be formed. The heat treatment makes it possible to obtain a high-strength powder magnetic core. In addition, the heat treatment in the fourth step is preferably performed at a temperature that does not allow significant sintering of the soft magnetic material powder. If the soft magnetic material powder is significantly sintered, the core loss can increase. Specifically, the heat treatment temperature is preferably in the range of 600 to 900° C., more preferably in the range of 700 to 800° C. The holding time is appropriately set depending on the size of the powder magnetic core, the quantity to be treated, the tolerance for variations in properties, or other conditions. The holding time is preferably, for example, from 0.5 to 3 hours.

An additional step may be performed before or after each of the first to fourth steps.

Figure 9:
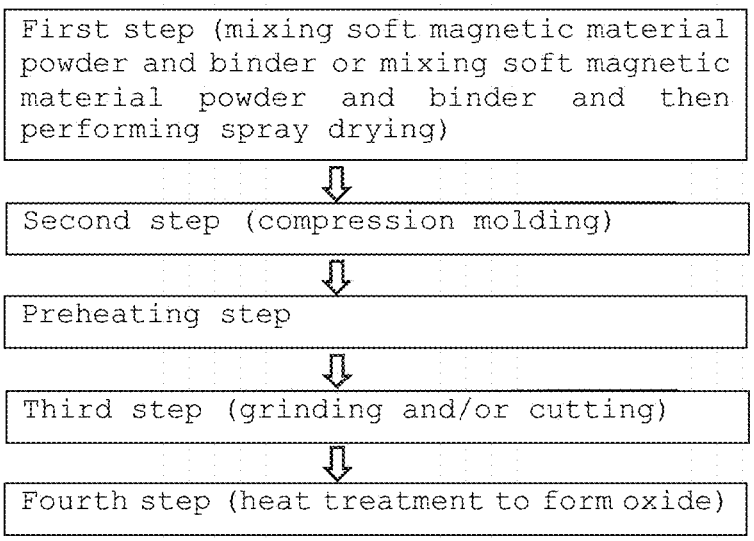
FIG. 9 is a process flow chart for illustrating a further embodiment of the method according to the invention for manufacturing a powder magnetic core.

For example, when a powder magnetic core having a complicated shape or a thin part is produced, there is a risk of breakage of the powder magnetic core in the third step. In such a case, the strength of the compact to be subjected to the third step is preferably made higher than that immediately after the molding. Specifically, as shown in FIG. 9, a preheating step including heating the compact at a temperature lower than the heat treatment temperature in the fourth step is preferably performed between the second and third steps described above. The heating at a temperature lower than the heat treatment temperature in the fourth step also increases the strength of the compact while the heat treatment in the fourth step forms an oxide layer, which contains an element constituting the soft magnetic material powder, on the surface of the soft magnetic material particles, and significantly increases the strength of the resulting powder magnetic core. For the validity of the heating, the heating temperature in the preheating step is set higher than room temperature. On the other hand, too high a heating temperature will make difficult the working in the third step. Therefore, the temperature of the preheating, if performed, should be lower than the heat treatment temperature in the fourth step. For example, in the case of the Fe—Cr—M (M is at least one of Al and Si) alloy, the heating temperature is preferably not higher than the temperature at which the non-Fe element in the soft magnetic material powder, such as Al or Cr, is oxidized and concentrated at grain boundaries, more preferably 300° C. or lower. A heating temperature of 300° C. or lower is also preferable in that it is suitable not only for the Fe—Cr—M soft magnetic material powder but also for other soft magnetic material powders. The heating temperature is also preferably 100° C. or higher in order to enhance the effect of improving the strength by heating. Too short a heat holding time is less effective in improving the strength of the compact, and an unnecessarily long heat holding time can reduce productivity. Therefore, the heat holding time is, for example, preferably from 10 minutes to 4 hours, more preferably from 30 minutes to 3 hours. The atmosphere during the preheating is not limited to an oxidizing atmosphere. The air is a preferred atmosphere, under which the step can be simple.

After the preheating step, the compact to be subjected to the third step can have a strength of more than 15 MPa.

Before the first step, an additional preliminary step including forming an insulating coating on the soft magnetic material powder by a heat treatment, a sol-gel method, or other methods may also be performed. However, this preliminary step is preferably omitted so that the manufacturing process can be simplified, because an oxide layer is successfully formed on the surface of the soft magnetic material particles in the fourth step of the powder magnetic core manufacturing method according to the invention. The oxide layer itself also resists plastic deformation. Therefore, the process used includes forming the oxide layer after the shaping, so that in particular the high formability of the Fe—Cr—Al or Fe—Cr—Al—Si alloy powder can be effectively utilized in the compression molding of the second step.

There are also some cases where the core obtained after the fourth step has burrs or needs to be subjected to dimensional adjustment. In such cases, the method may further include a fifth step including further performing at least one of grinding and cutting on the powder magnetic core obtained after the fourth step; and a sixth step including heat-treating the powder magnetic core obtained after the fifth step, in which an oxide layer containing an element constituting the soft magnetic material particles is formed, by the heat treatment of the sixth step, on the surface worked in the fifth step.

The powder magnetic core itself obtained as described above has advantageous effects. Specifically, the powder magnetic core has a high level of strength and insulating properties when having a drum shape, which is a typical complicated shape. The specific features of the powder magnetic core are, for example, as follows. The powder magnetic core, which includes metallic soft magnetic material particles, has a drum shape including a coil holding part and flanges at both ends of the coil holding part, in which the metallic soft magnetic material particles are bonded together with an oxide layer that is interposed therebetween and contains an element constituting the soft magnetic material particles, and the coil holding part has a worked surface and an oxide layer containing an element constituting the soft magnetic material particles.

The phrase "the coil holding part has a worked surface" indicates that the coil holding part is formed by mechanical working such as grinding or cutting regardless of the surface conditions of the coil holding part. Therefore, even when an oxide layer is formed on the coil holding part surface formed by mechanical working, the surface of the coil holding part is a worked surface. In this case, the arithmetic average roughness of the coil holding part surface is larger than the arithmetic average roughness of the outer surface of the flange. In addition, the metallic soft magnetic material particles are bonded together with an oxide layer that is interposed therebetween and contains an element constituting the soft magnetic material particles. This means that high strength and insulation are ensured even when mechanical working is performed. The oxide layer containing an element constituting the soft magnetic material particles is also provided on the surface of the coil holding part. Therefore, the insulation of the surface of the coil holding part is also ensured even when the coil holding part is formed through working.

In addition, after the spray drying and other steps described above, the resulting powder magnetic core can have both a worked surface and an unworked surface and have a ratio of $R_{MD}$ to $R_{AS}$ ($R_{MD}/R_{AS}$) of 5 or less, wherein $R_{MD}$ is the average of arithmetic average roughness Ra values of the worked surface (e.g., the surface of the coil holding part), and $R_{AS}$ is the average of arithmetic average roughness Ra values of the unworked surface (e.g., the axial end surface). The ratio $R_{MD}/R_{AS}$ is more preferably 3 or less.

The powder magnetic core preferably has an average of maximum sizes of the soft magnetic material particles of 15 μm or less, more preferably 8 μm or less, as measured in its cross-sectional observation image. In particular, the powder magnetic core composed of fine particles of the soft magnetic material can have improved high-frequency properties. On the other hand, the average of maximum sizes is preferably 0.5 μm or more in order to suppress the reduction in magnetic permeability. The average of maximum sizes may be determined by polishing the cross-section of the powder magnetic core, observing the polished cross-section with a microscope, reading the maximum sizes of particles in a field of view with a certain area, and calculating the number average of the maximum sizes. In this case, the average is preferably calculated for 30 or more particles. After the shaping, the soft magnetic material particles are plastically deformed, but in the cross-sectional observation, the exposed surfaces of most particles are deviated from the center, and therefore, the average of maximum sizes is smaller than the median diameter d50 determined by evaluation of the powder.

As mentioned above, a powder magnetic core with high corrosion resistance can be produced using the Fe—Cr—M (M is at least one of Al and Si) alloy powder as the metallic soft magnetic material powder. In addition, the use of the Fe—Cr—Al or Fe—Cr—Al—Si soft magnetic material powder, which contains Al as the M element, is advantageous for achieving high formability, high space factor, and high powder magnetic core strength. In particular, the use of the Fe—Cr—Al soft magnetic material powder makes it possible to increase the space factor (relative density) of the powder magnetic core at low molding pressure and to improve the strength of the powder magnetic core. Based on these effects, the space factor of the soft magnetic material particles in the powder magnetic core after the heat treatment is preferably set in the range of 80 to 92%. This range is preferred because an increase in the space factor can improve the magnetic properties but an excessive increase in the space factor can increase the facility burden and cost. The space factor is more preferably in the range of 84 to 90%.

The features of the powder magnetic core described above are advantageous for a flat drum shape in which the diameter or side-length of at least one of the flanges at both ends is larger than the axial dimension. This is because it is difficult to obtain such a shape only by die molding.

There is provided a coil component including the powder magnetic core and a coil wound around the powder magnetic core. The coil may be formed by winding a conducting wire on the powder magnetic core or a bobbin. The coil component including the powder magnetic core and the coil may be used as, for example, a choke, an inductor, a reactor, or a transformer.

The powder magnetic core may be produced in the form of a simple powder magnetic core, which is obtained through compression molding of only a mixture including the soft magnetic material powder, the binder, and other components as described above, or may be produced in the form of a coil-sealed powder magnetic core, which is obtained through integrally subjecting the soft magnetic material powder and a coil to compression molding.

EXAMPLES (Evaluation of Difference in Properties Depending on Difference in Constituent Element)

First, the properties of different soft magnetic material powders for use in the powder magnetic core manufacturing method were evaluated as described below. Spherical atomized particles of an Fe—Cr—Al soft magnetic material were prepared, in which the soft magnetic material had an alloy composition (composition A) of Fe-4.0% Cr-5.0% Al (in mass percentage). The particles had an average particle size (median diameter d50) of 18.5 μm as measured with a laser diffraction/scattering particle size distribution analyzer (LA-920 manufactured by HORIBA, Ltd.).

The resulting soft magnetic material powder and an acrylic resin emulsion binder (Polysol AP-604 manufactured by SHOWA HIGHPOLYMER CO., LTD., solid content 40%) were mixed in a ratio of 100 parts by weight (powder): 2.0 parts by weight (binder). The mixed powder was dried at 120° C. for 1 hour and then allowed to pass through a sieve to give a granulated powder with an average particle size (d50) in the range of 60 to 80 μm. Based on 100 parts by weight of the soft magnetic material powder, 0.4 parts by weight of zinc stearate was added to the granulated powder and mixed to form a mixture for molding.

The resulting mixture was compression-molded under a molding pressure of 0.91 GPa at room temperature using a press. The space factor of the compact evaluated was 84.6%. The resulting toroidal compact was heat-treated in the air at a temperature of 800° C. for 1.0 hour to forma powder magnetic core (No. 1).

Similarly, an Fe—Cr—Si soft magnetic material powder with an alloy composition (composition B) of Fe-4.0% Cr-3.5% Si (in mass percentage) and an Fe—Si soft magnetic material powder with an alloy composition (composition C) of Fe-3.5% Si (in mass percentage) were each subjected to mixing and compression molding under the same conditions as those for No. 1 to form compacts. The compacts were heat-treated under the conditions of 700° C. and 500° C., respectively, to form powder magnetic cores (Nos. 2 and 3). When the Fe—Si soft magnetic material powder was used, the heat treatment temperature used was 500° C. because the heat treatment at a temperature of higher than 500° C. could increase the core loss.

The density of each powder magnetic core prepared by the above process was calculated from its dimension and weight. The space factor (relative density) was then calculated by dividing the density of the powder magnetic core by the true density of the soft magnetic material powder. The maximum breaking load P (N) was measured under a load in the direction of the diameter of the toroidal powder magnetic core, and the radial crushing strength or (MPa) was calculated from the following formula: $\sigma r = P(D-d)/(Id^2)$, wherein D is the outer diameter (mm) of the core, d is the radial thickness (mm) of the core, and I is the height (mm) of the core.

Using 15 turns of wire on the primary and 15 turns of wire on the secondary, the core loss Pcv was measured under the conditions of a maximum magnetic flux density of 30 mT and a frequency of 300 kHz using B-H Analyzer SY-8232 manufactured by IWATSU TEST INSTRUMENTS CORPORATION. In addition, the toroidal powder magnetic core with 30 turns of wire was measured for initial magnetic permeability μi at a frequency of 100 kHz with 4284A manufactured by Hewlett-Packard Company.

TABLE 1

| No | Composition | Heat treatment temperature (° C.) | Space factor (%) | Radial crushing strength (MPa) | Pcv (kW/m$^3$) | μi |
|---|---|---|---|---|---|---|
| 1 | A (Fe—4.0Cr—5.0Al) | 800 | 88.2 | 238 | 488 | 49 |
| 2 | B (Fe—4.0Cr—3.5Si) | 700 | 82.0 | 75 | 536 | 35 |
| 3 | C (Fe—3.5Si) | 500 | 83.0 | 65 | 350 | 35 |

As shown in Table 1, the powder magnetic core Nos. 1 and 2, which were produced with an Fe—Cr-M soft magnetic material powder, each had a radial crushing strength higher than that of the powder magnetic core No. 3, which was produced with an Fe—Si soft magnetic material powder, while having magnetic properties equivalent or superior to those of the powder magnetic core No. 3. Therefore, the features of Nos. 1 and 2 made it possible to form powder magnetic cores with high strength by simple compression molding. In addition, the powder magnetic core No. 1, which was produced with an Fe—Cr—Al soft magnetic material powder, had a significantly higher level of space factor and magnetic permeability than the powder magnetic core No. 3, which was produced with an Fe—Si soft magnetic material powder, and the powder magnetic core No. 2, which was produced with an Fe—Cr—Si soft magnetic material powder. The powder magnetic core No. 1 also exhibited a high radial crushing strength of at least 100 MPa, which was at least twice higher than that of the powder magnetic core No. 2 produced with an Fe—Cr—Si soft magnetic material powder. Therefore, it has been found that the use of an Fe—Cr—Al soft magnetic material powder is very advantageous for achieving a high radial crushing strength. Separately, the powder magnetic cores were evaluated for corrosion resistance by a brine spray test. As a result, the powder magnetic core No. 3 produced with an Fe—Si soft magnetic alloy powder was significantly corroded and had insufficient corrosion resistance in a harsh corrosive environment. Therefore, it has been found that the powder magnetic core No. 3 produced with an Fe—Si soft magnetic alloy powder is suitable for use in applications requiring low core loss but not requiring high corrosion resistance. The powder magnetic core Nos. 1 and 2 were resistant to corrosion, in which the corrosion resistance of the powder magnetic core No. 1 was higher than that of the powder magnetic core No. 2.

Figure 3:
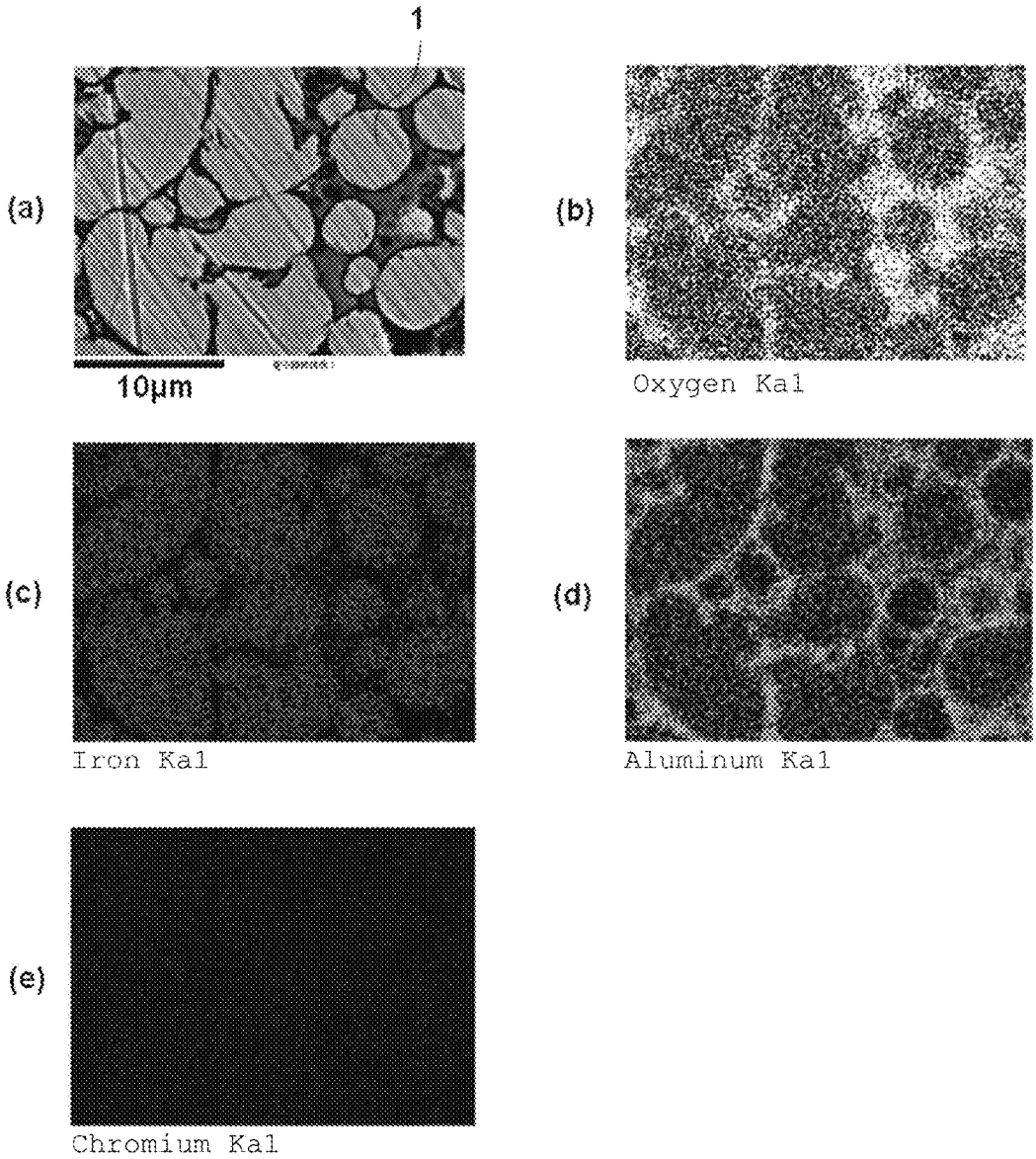
FIGS. 3(*a*) to 3(*e*) are SEM photographs of the cross-section of a powder magnetic core.

Using a scanning electron microscope (SEM/EDX), the cross-section of the powder magnetic core No. 1 was observed, and the distribution of each constituent element in the powder magnetic core No. 1 was observed at the same time. FIGS. 3(*a*) to 3(*e*) show the results. FIG. 3(*a*) is an SEM image showing that a phase with a black tone is formed on the surface of the soft magnetic material powder (soft magnetic material particles) with a bright gray tone. Using the SEM image, the average of the maximum particle sizes of at least 30 soft magnetic material particles was calculated to be 8.8 μm. FIGS. 3(*b*) to 3(*e*) are mappings showing the distributions of O (oxygen), Fe (iron), Al (aluminum), and Cr (chromium), respectively. The brighter tone indicates a higher content of the subject element.

FIGS. 3(*a*) to 3(*e*) show that an oxide is formed on the surface (oxygen-rich area) of the soft magnetic material particles and that soft magnetic material (alloy) particles are bonded together with the oxide interposed therebetween. The Fe concentration is lower at the surface of the soft magnetic material particles than in the inner part, and the Cr concentration does not show a large distribution. On the other hand, the Al concentration is significantly higher at boundaries between the soft magnetic material particles. These facts have demonstrated that an oxide layer containing an element constituting the soft magnetic material particles is formed at boundaries between the soft magnetic material particles and that the ratio of the Al content to the total content of Fe, Cr, and Al is higher in the oxide layer than in the inner alloy phase. Before the heat treatment, the concentration distribution of each constituent element as shown in FIGS. 3(*b*) to 3(*e*) was not observed, and it was also found that the oxide layer was formed by the heat treatment. It has also been found that the oxide layers with a relatively high Al content are connected at grain boundaries.

Figure 4:
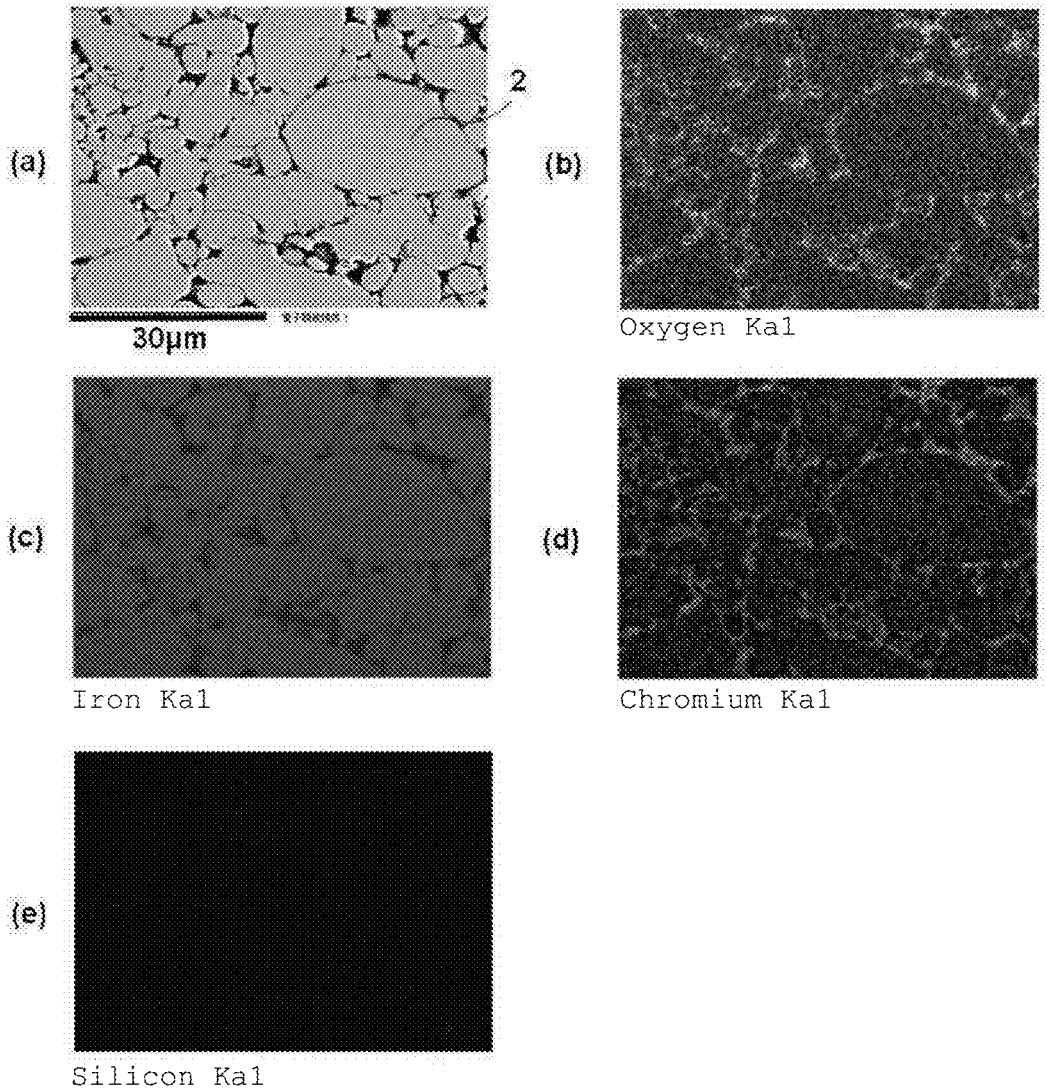
FIGS. 4(*a*) to 4(*e*) are SEM photographs of the cross-section of a powder magnetic core.

Using a scanning electron microscope (SEM/EDX), the cross-section of the powder magnetic core No. 2 was also observed, and the distribution of each constituent element in the powder magnetic core No. 2 was observed at the same time. FIGS. 4(*a*) to 4(*e*) show the results. FIG. 4(*a*) is an SEM image showing that a phase with a black tone is formed on the surface of the soft magnetic material particles 1 with a bright gray tone. FIGS. 4(*b*) to 4(*e*) are mappings showing the distributions of O (oxygen), Fe (iron), Cr (chromium), and Si (silicon), respectively.

FIGS. 4(*a*) to 4(*e*) show that an oxide is formed at boundaries (oxygen-rich area) between soft magnetic material particles and that soft magnetic material particles are bonded together with the oxide interposed therebetween. The Fe concentration is lower at boundaries between the soft magnetic material particles than in the inner part, and the Si concentration does not show a large distribution. On the other hand, the surface of the soft magnetic material particles has a significantly higher Cr concentration. These facts have demonstrated that an oxide layer containing an element constituting the soft magnetic material particles is formed at the surface of the soft magnetic material particles and that the ratio of the Cr content to the total content of Fe, Cr, and Si is higher in the oxide layer than in the inner alloy phase. Before the heat treatment, the concentration distribution of each constituent element as shown in FIGS. 4(*b*) to 4(*e*) was not observed, and it was also found that the oxide layer was formed by the heat treatment. It has also been found that the oxide layers with a relatively high Cr content are connected at grain boundaries.

Concerning the powder magnetic core Nos. 1 and 2 produced with the Fe—Cr—M soft magnetic material powder and both containing Cr, it has been found that the boundaries between the soft magnetic material particles become Cr-rich when the soft magnetic material does not contain Al as the M element and that the boundaries significantly become Al-rich rather than Cr-rich when the soft magnetic material contains Al as the M element.

Next, spherical atomized particles with an alloy composition (composition D) of Fe-3.9% Cr-4.9% Al-1.9% Si (in mass percentage) and spherical atomized particles with an alloy composition (composition E) of Fe-3.8% Cr-4.8% Al-2.9% Si (in mass percentage) were prepared as Fe—Cr—M soft magnetic material powders different in Si content from composition A, and used to form powder magnetic cores as described below. The atomized powder with composition D and the atomized powder with composition E had average particle sizes (median diameters d50) of 14.7 μm and 11.6 μm, respectively, as measured with a laser diffraction/scattering particle size distribution analyzer (LA-920 manufactured by HORIBA, Ltd.).

The soft magnetic material powder with composition D and the soft magnetic material powder with composition E were each mixed with a PVA binder (POVAL PVA-205 manufactured by KURARAY CO., LTD., solid content 10%). The mixing ratio was 100 parts by weight (powder): 2.5 parts by weight (binder). The resulting mixture was dried at 120° C. for 1 hour and then allowed to pass through a sieve to give a granulated powder with an average particle size (d50) in the range of 60 to 80 μm. Based on 100 parts by weight of the granulated powder, 0.4 parts by weight of zinc stearate was added to the granulated powder and mixed to form a mixture for molding. The resulting mixture was compression-molded under a molding pressure of 0.74 GPa at room temperature using a press, so that a toroidal compact with an inner diameter of 7.8 mmφ, an outer diameter of 13.5 mmφ, and a thickness of 4.3 mm was obtained. The space factors of the compacts evaluated were 80.9% (composition D) and 78.3% (composition E), respectively. The resulting compacts were heat-treated in the air at a temperature of 750° C. for 1.0 hour to form powder magnetic cores (Nos. 4 and 5). The magnetic and other properties of the compacts were evaluated in the same manner as for Nos. 1 to 3 shown above. Table 2 shows the evaluation results.

TABLE 2

| No | Composition | Space factor (%) | Radial crushing strength (MPa) | Pcv (kW/m$^3$) | μi |
|---|---|---|---|---|---|
| 4 | D (Fe—3.9Cr—4.9Al—1.9Si) | 85.5 | 172 | 363 | 63 |
| 5 | E (Fe—3.8Cr—4.8Al—2.9Si) | 84.7 | 175 | 340 | 52 |

As shown in Table 2, due to the addition of Si, the powder magnetic core Nos. 4 and 5 produced with an Fe—Cr—Al—Si soft magnetic material powder had improved magnetic properties as compared with the powder magnetic core No. 1. It is also apparent that the powder magnetic core Nos. 4 and 5 had a sufficient radial crushing strength not lower than 100 MPa even when produced under reduced molding pressure conditions, although their radial crushing strength was slightly lower than that of the powder magnetic core No. 1. Therefore, it has been found that the addition of Si is disadvantageous for achieving high radial crushing strength but the simultaneous addition of Si and Al can ensure high radial crushing strength.

Figure 5:
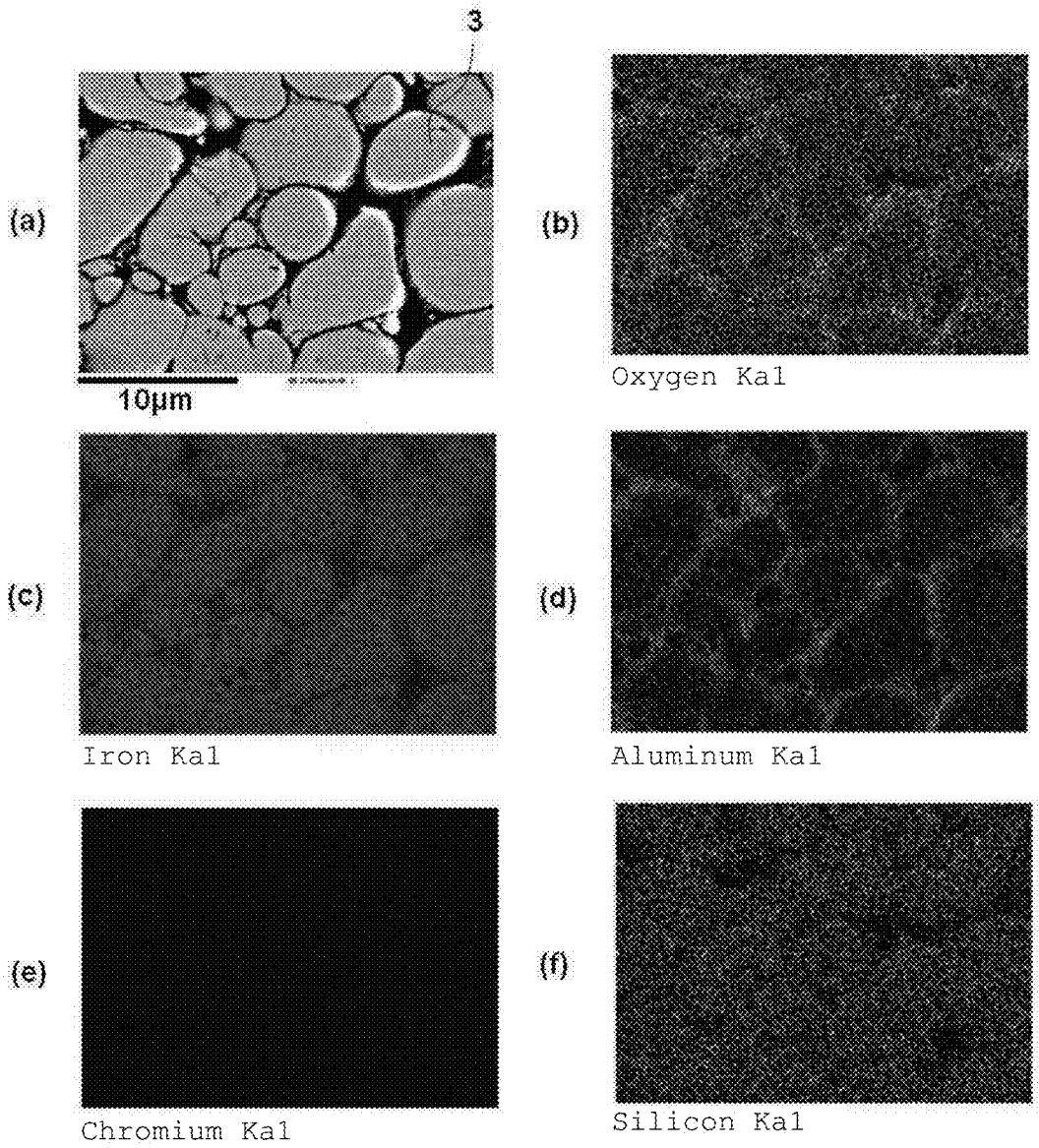
FIGS. 5(*a*) to 5(*f*) are SEM photographs of the cross-section of a powder magnetic core.
Figure 6:
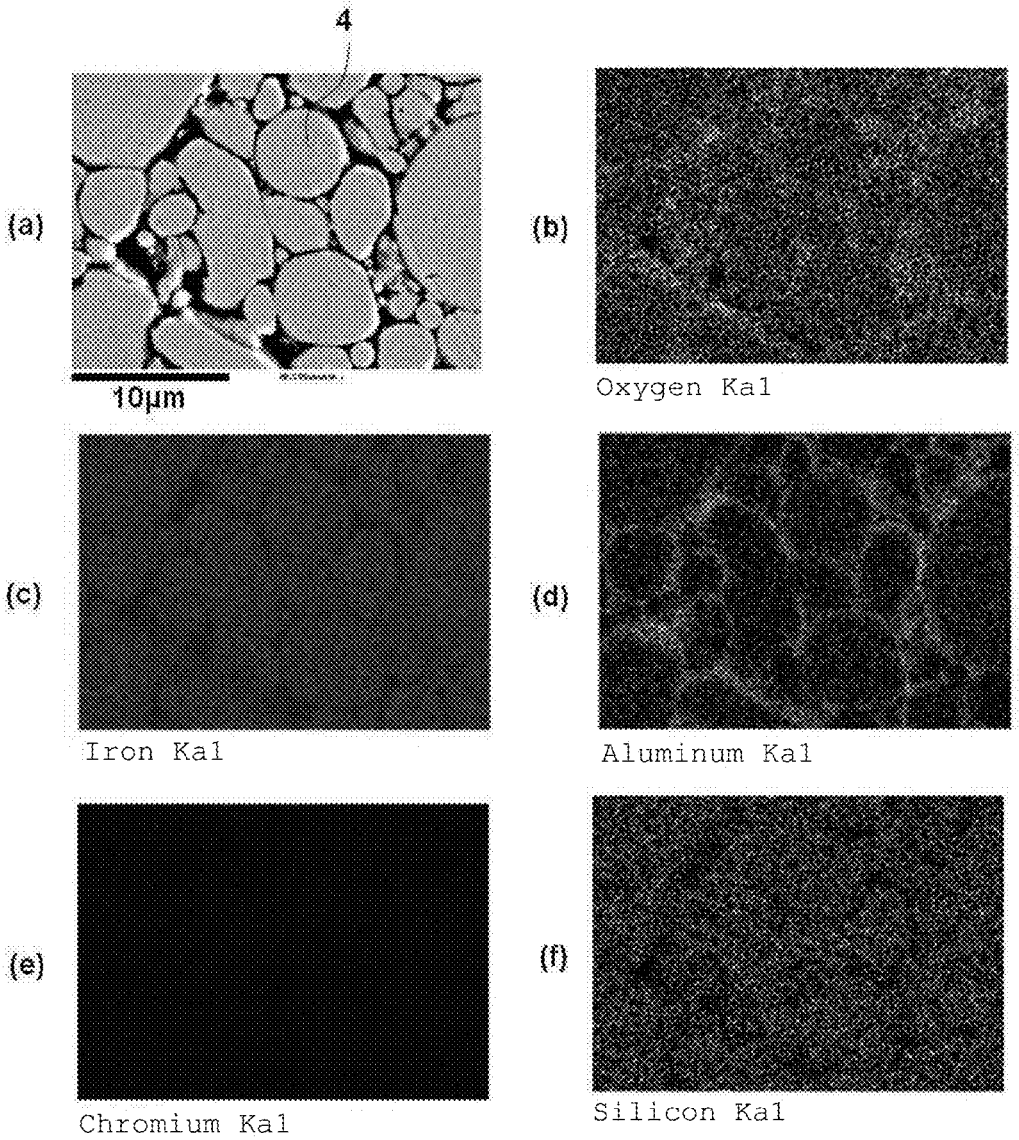
FIGS. 6(*a*) to 6(*f*) are SEM photographs of the cross-section of a powder magnetic core.

The cross-sections of the powder magnetic core Nos. 4 and 5 were observed using a scanning electron microscope (SEM/EDX). As a result, it has been found that in the powder magnetic core Nos. 4 and 5, an oxide is formed at boundaries (oxygen-rich area) between the soft magnetic material particles as in the powder magnetic core No. 1 and that the soft magnetic material particles are bonded together with the oxide interposed therebetween (FIGS. 5(*a*) to 5(*f*)

and 6(*a*) to 6(*f*)). It has also been found that the Fe concentration is lower at boundaries between the soft magnetic material particles than in the inner part, the Cr concentration does not show a large distribution, and the Al concentration is significantly higher at boundaries between the soft magnetic material particles.

Therefore, it has been demonstrated that it is advantageous to form an oxide layer, containing an element constituting soft magnetic material particles, on the surface of the soft magnetic material particles by heat-treating a compact in the process of producing a powder magnetic core with a metallic soft magnetic material powder, specifically, an Fe—Cr—M (M is at least one of Al and Si) soft magnetic material powder.

Example 1

Hereinafter, an example of the invention having the first to fourth steps will be described. Drum-shaped powder magnetic cores (Nos. 6 and 7) were prepared as described below using a soft magnetic material powder with the same composition as that of No. 1 (composition A) and a soft magnetic material powder with the same composition as that of No. 4 (composition D), respectively. The soft magnetic material powder and a PVA binder (POVAL PVA-205 manufactured by KURARAY CO., LTD., solid content 10%) were mixed in a ratio of 100 parts by weight (powder):2.5 parts by weight (binder) (the first step). The resulting mixture was dried at 120° C. for 1 hour and then allowed to pass through a sieve to give a granulated powder with an average particle size (d50) in the range of 60 to 80 μm. Based on 100 parts by weight of the granulated powder, 0.4 parts by weight of zinc stearate was added to the granulated powder and mixed to form a mixture to be subjected to compression molding. The resulting mixture was compression-molded under a molding pressure of 0.74 GPa at room temperature using a press, so that a cylindrical compact was obtained (the second step). The resulting compact had a dimension of 10.2 mmφ×7.5 mm. The space factors of the compacts evaluated were 84.0% for the powder magnetic core No. 6 and 82.3% for the powder magnetic core No. 7.

Figure 7:
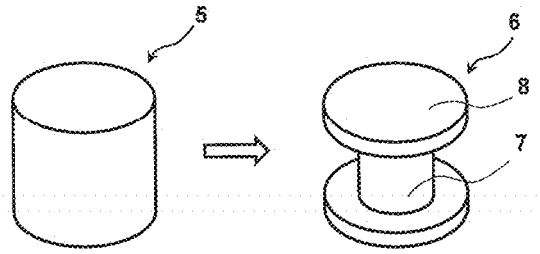
FIG. 7 is a perspective view showing the shape of a compact before working and the shape of a compact (powder magnetic core) after working.

The outer side surface of the cylindrical compact obtained after the second step was subjected to grinding using a rotary grindstone (the third step). FIG. 7(*a*) shows the shape of the compact before the working of the third step, and FIG. 7(*b*) shows the shape after the working. In the grinding, the cylindrical compact 5 was ground from the side, except for both axial end parts. After the grinding, the shape of the compact 6 was a drum shape including a coil holding part 7 formed by grinding and flanges 8 at both ends thereof. The flanges had a diameter of 10.2 mm and a height of 7.5 mm, and the coil holding part had a diameter of 4.8 mm. Good workability was achieved without any chipping problem.

The compact obtained as described above was heat-treated in the air at a temperature of 750° C. for 1.0 hour (the fourth step), so that a powder magnetic core was obtained.

Figure 8:
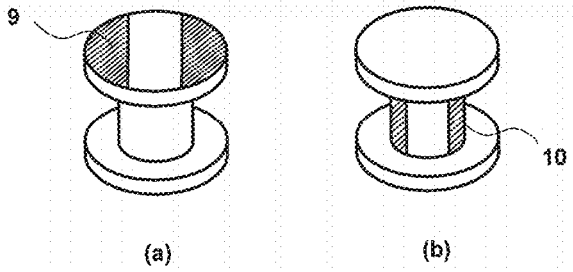
FIGS. 8(*a*) and 8(*b*) are perspective views showing the arrangement of electrodes for measuring the resistance of a powder magnetic core.

The resistance of the drum-shaped powder magnetic core obtained as described above was evaluated as described below. Electrodes 9 were formed by applying a silver paste to parts (3 mm apart from each other) of the circular surface of one of the flanges (FIG. 8(*a*)), with which the in-plane resistance of the flange was measured (the in-plane resistance of the flange). Electrodes 10 were also formed by applying a silver paste to two side parts (4 mm apart from each other) of the coil holding part with the axis between them (FIG. 8(*b*)), with which the resistance of the shaft part formed by grinding was measured (the resistance of the coil holding part). The resistance was measured at a voltage of 300 V by two-terminal method using 8340A manufactured by ADC Corporation. Table 3 shows the evaluation results.

TABLE 3

| No | Composition | Site for evaluation | Resistance (Ω) |
|---|---|---|---|
| 6 | A (Fe—4.0Cr—5.0Al) | In-plane resistance of flange | $2.3 \times 10^5$ |
| | | Resistance of coil holding part | $1.5 \times 10^5$ |
| 7 | D (Fe—3.9Cr—4.9Al—1.9Si) | In-plane resistance of flange | $1.9 \times 10^4$ |
| | | Resistance of coil holding part | $1.2 \times 10^4$ |

Table 3 shows that the coil holding part formed by grinding has a high resistance, which is a similar level to the in-plane resistance of the flange, so that sufficient insulating properties are ensured. In both of the powder magnetic core Nos. 6 and 7, an oxide layer containing an element constituting the soft magnetic material particles is formed on the surface of the soft magnetic material particles, and the ratio of the Cr content to the total content of Fe, Cr, and Si is higher in the oxide layer than in the inner alloy phase. The same oxide layer was also formed on the surface of the coil holding part. On the other hand, for comparison, an attempt was made to forma drum shape with the same dimension by grinding after the heat treatment, but the powder magnetic core after the heat treatment was too hard to be worked into the desired shape. It was also found that the worked surface was conductive and did not have reliable insulting properties. The ring surfaces of the powder magnetic core Nos. 4 and 5 were also subjected to grinding after the heat treatment. As a result, it was found that the worked surface was conductive and did not have reliable insulating properties.

Example 2

Using a soft magnetic material powder with the same composition as that of No. 1 (composition A), a drum-shaped powder magnetic core was prepared as described below. A slurry was formed by mixing the soft magnetic material powder and a PVA binder (POVAL PVA-205 manufactured by KURARAY CO., LTD., solid content 10%) in a ratio of 100 parts by weight (powder):10.0 parts by weight (binder) and adding ion-exchanged water as a solvent to the mixture. The slurry had a concentration of 80% by weight. In a spray dryer, the slurry was sprayed and instantly dried with hot air at a controlled temperature of 240° C., and the resulting granules were collected (the first step). The resulting mixture was dried at 120° C. for 1 hour and then allowed to pass through a sieve to give a granulated powder with an average particle size (d50) in the range of 60 to 80 μm. Based on 100 parts by weight of the granulated powder, 0.4 parts by weight of zinc stearate was added to the granulated powder and mixed to form a mixture to be subjected to compression molding. The resulting mixture was compression-molded under a molding pressure of 0.74 GPa at room temperature using a press, so that a cylindrical compact was obtained (the second step). The resulting compact had a dimension of 10.2 mmφ×7.5 mm. The space factor of the compact evaluated was 82.5%.

In the same manner as in Example 1, the outer side surface of the cylindrical compact obtained after the second step was subjected to grinding using a rotary grindstone (the third step). The flange of the resulting drum shape had a diameter of 10.2 mm and a height of 7.5 mm, and the coil holding part of the resulting drum shape had a diameter of 4.8 mm. Good workability was achieved without any chipping problem. The resulting compact was heat-treated in the air at a temperature of 750° C. for 1.0 hour, so that a powder magnetic core was obtained. In the resulting powder magnetic core, an oxide layer containing an element constituting the soft magnetic material particles was formed on the surface of the soft magnetic material particles, and the ratio of the Cr content to the total content of Fe, Cr, and Si was higher in the oxide layer than in the inner alloy phase. The same oxide layer was also formed on the surface of the coil holding part. The worked surface of the resulting powder magnetic core was smoother than that of the powder magnetic core of Example 1. The arithmetic average roughness Ra of the worked surface (the surface of the coil holding part) and the arithmetic average roughness Ra of the unworked surface (the surface from the molding punch (the axial end surface)) were measured using Ultra-Deep Shape Measuring Microscope VK-8500 manufactured by KEYENCE CORPORATION. The measurement was performed on ten parts in total including two parts (a central part of the unworked surface (the surface from the molding punch) and an axial center part of the worked surface (the surface of the coil holding part)) of the surface of each of the five powder magnetic cores. The evaluated area per part was 0.32 $mm^2$. The unworked surface (the surface from the molding punch) had arithmetic average roughness Ra values in the range of 1.10 to 2.01, and the average thereof was 1.40 μm. Therefore, the arithmetic average roughness Ra of the unworked surface (the surface from the molding punch) was kept within the range of 0 to 2 μm. On the other hand, the worked surface had arithmetic average roughness Ra values in the range of 3.17 to 4.99, and the average thereof was 4.11 μm. Thus, the average $R_{MD}$ of the arithmetic average roughness Ra values of the worked surface (the surface of the coil holding part) was at most 5 μm, which was larger than the average $R_{AS}$ of the arithmetic average roughness Ra values of the unworked surface (the axial end surface), but the ratio $R_{MD}/R_{AS}$ was controlled to about 2.9.

Example 3

<Preliminary Evaluation of Strength>

Using a soft magnetic material powder with the same composition as that of No. 1 (composition A), a drum-shaped powder magnetic core was prepared as described below. A slurry was formed by mixing the soft magnetic material powder and a PVA binder (POVAL PVA-205 manufactured by KURARAY CO., LTD., solid content 10%) in a ratio of 100 parts by weight (powder):10.0 parts by weight (binder) and adding ion-exchanged water as a solvent to the mixture. The slurry had a concentration of 80% by weight. In a spray dryer, the slurry was sprayed and instantly dried with hot air at a controlled temperature of 240° C., and the resulting granules were collected (the first step). The resulting mixture was dried at 120° C. for 1 hour and then allowed to pass through a sieve to give a granulated powder with an average particle size (d50) in the range of 60 to 80 μm. Based on 100 parts by weight of the granulated powder, 0.4 parts by weight of zinc stearate was added to the granulated powder and mixed to form a mixture. The resulting mixed powder was compression-molded under a molding pressure of 0.74 GPa at room temperature using a press, so that a cylindrical compact was obtained (the second step). The resulting compact had a toroidal shape with a dimension of 7.8 mmφ in inner diameter, 13.5 mmφ in outer diameter, and 4.3 mm in thickness. The resulting compact had a space factor of 81.3%. The compact was subjected to a preheating treatment at the temperature of 150 to 900° C. shown in Table 4 for a holding time of 2 hours and then subjected to the evaluation of strength in the same manner as for the powder magnetic core Nos. 1 to 5.

Figure 10:
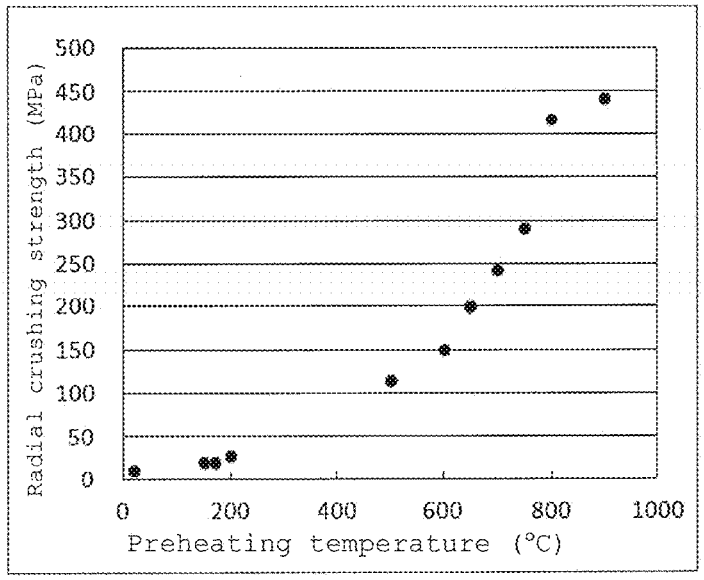
FIG. 10 is a graph showing the relationship between preheating treatment temperature and powder magnetic core strength.

Table 4 and FIG. 10 show the preheating temperature dependency of the strength of the compact. As shown in FIG. 10, the strength of the compact increased with increasing preheating treatment temperature. When the preheating temperature was 100° C. or higher, the resulting compact had a strength of more than 15 MPa. It was also found that the slope of the change in strength depending on the preheating temperature was different between the temperature range of 300° C. or lower, where the strength seems to be improved mainly by the curing of the binder, and the temperature range of 500° C. or higher, where an oxide is formed to bond the metallic soft magnetic material particles strongly. It was found that in view of workability, the preheating treatment temperature is in particular preferably in the range of 300° C. or lower, where the slope of the change in strength is small and the absolute value of the resulting strength is not too large.

TABLE 4

| Preheating temperature (° C.) | Compact strength (MPa) |
|---|---|
| 20 (no heating) | 11.9 |
| 150 | 20.5 |
| 170 | 21.1 |
| 200 | 28.7 |
| 500 | 116 |
| 600 | 151 |
| 650 | 200 |
| 700 | 243 |
| 750 | 291 |
| 800 | 418 |
| 900 | 442 |

<Evaluation of Drum-Shaped Core>

From the results shown in FIG. 10, the preheating temperature was set to 200° C., when a drum-shaped powder magnetic core was produced. The same raw material powder was used as that in the preliminary evaluation of the compact strength described above. The powder was compression-molded under a molding pressure of 0.74 GPa at room temperature using a press, so that a cylindrical compact was obtained (the second step). The resulting compact had a dimension of 4 mmφ×1 mm. The space factor of the resulting compact was 81.5%. The preheating step was performed in which the compact was held at 200° C. for 2 hours. Subsequently, the compact was subjected to grinding with a diamond wheel 0.35 mm in blade width to form a shaft with a diameter (a coil holding part diameter) of 1.75 mm (the third step), so that a drum-shaped powder magnetic core was obtained. For comparison, a drum-shaped powder magnetic core was formed by the same method, except that the preheating step was not performed. The powder magnetic cores were subjected to the fourth step, in which a heat treatment was performed under the same conditions as those for No. 6 shown above. In the resulting powder magnetic cores, an oxide layer containing an element constituting the soft magnetic material particles was formed on the surface of the soft magnetic material particles, and the ratio of the Cr content to the total content of Fe, Cr, and Si was higher in the oxide layer than in the inner alloy phase. The same oxide layer was also formed on the surface of the coil holding part.

The powder magnetic core produced by the method without the preheating step was cracked at the boundary between the flange and the shaft (the coil holding part) or chipped at the peripheral part of the flange. However, the powder magnetic core produced through the preheating step had no cracking or chipping. Thus, high quality was achieved without any defects in the highly-flat, drum-shaped powder magnetic core, where the diameter (maximum dimension) of the flanges at both ends was at least twice the axial dimension.

DESCRIPTION OF REFERENCE SIGNS

1 to 4 soft magnetic material powder (soft magnetic material particles)
5 compact
6 compact (after grinding)
7 coil holding part
8 flange
9 electrode
10 electrode

The invention claimed is:

1. A method for manufacturing a powder magnetic core with a metallic soft magnetic material powder, the method comprising:

a first step comprising mixing the soft magnetic material powder and a binder;

a second step comprising compression molding the mixture obtained after the first step;

a third step comprising performing at least one of grinding and cutting on a compact obtained after the second step; and a fourth step comprising heat-treating the compact after the third step, wherein in the fourth step, the compact is heat-treated so that an oxide layer containing an element constituting the soft magnetic material powder is formed on a surface of the soft magnetic material powder;

wherein the method forms the powder magnetic core which has a ratio of $R_{MD}$ to $R_{AS}$ ($R_{MD}/R_{AS}$) of 5 or less, wherein $R_{MD}$ is the average of arithmetic average roughness Ra values of a worked surface of the powder magnetic core, and $R_{AS}$ is the average of arithmetic average roughness Ra values of an unworked surface of the powder magnetic core.

2. The method according to claim 1, wherein the first step comprises spray drying a slurry containing the soft magnetic material powder and the binder.

3. The method according to claim 1, wherein the soft magnetic material powder is an Fe—Cr—Al soft magnetic material powder.

4. The method according to claim 1, further comprising a preheating step between the second step and the third step, wherein the preheating step comprises heating the compact at a temperature lower than the heat treatment temperature in the fourth step.

5. The method according to claim 1, wherein the compact subjected to the third step has a space factor of 78 to 90%.

6. The method according to claim 1, wherein at least one of the grinding and the cutting is performed on at least a coil holding part of the powder magnetic core.

7. The method according to claim 6, wherein the powder magnetic core has a drum shape comprising the coil holding part and flanges at both ends of the coil holding part.

8. The method according to claim 1, wherein the worked surface is the surface of a coil holding part of the powder magnetic core, and the unworked surface is an axial end surface of the powder magnetic core.

* * * * *